US006192837B1

(12) United States Patent
Wittchow

(10) Patent No.: US 6,192,837 B1
(45) Date of Patent: Feb. 27, 2001

(54) ONCE-THROUGH STEAM GENERATOR AND METHOD FOR STARTING UP A ONCE-THROUGH STEAM GENERATOR

(75) Inventor: Eberhard Wittchow, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/426,421

(22) Filed: Oct. 25, 1999

Related U.S. Application Data

(63) Continuation of application No. PCT/DE98/01055, filed on Apr. 14, 1998.

(30) Foreign Application Priority Data

Apr. 23, 1997 (DE) ..... 197 17 158

(51) Int. Cl.[7] ..... F22D 7/00

(52) U.S. Cl. ..... 122/406.4; 122/406.5; 122/1 B; 122/451 S

(58) Field of Search ..... 122/1 B, 6 A, 122/406.4, 406.5, 451 S

(56) References Cited

U.S. PATENT DOCUMENTS

| | | | | |
|---|---|---|---|---|
| 2,982,267 | | 5/1961 | Lieberherr . | |
| 3,003,479 | | 10/1961 | Bock et al. . | |
| 3,648,667 | * | 3/1972 | Dolezal | 122/406.5 |
| 3,771,498 | | 11/1973 | Gorzegno . | |
| 3,927,646 | * | 12/1975 | Dungey et al. | 122/6 A |
| 4,000,720 | * | 1/1977 | Lieb et al. | 122/6 A |
| 4,075,979 | * | 2/1978 | Michel | 122/406.4 |
| 4,290,389 | * | 9/1981 | Palchik | 122/406.4 |
| 4,294,200 | * | 10/1981 | Gorzegno | 122/406.4 |
| 5,713,311 | * | 2/1998 | Fitzgerald | 122/406.5 |

FOREIGN PATENT DOCUMENTS

| | | |
|---|---|---|
| 1 015 818 | 9/1957 | (DE) . |
| 1 263 873 | 3/1968 | (DE) . |
| 195 04 308 C1 | 8/1996 | (DE) . |
| 195 28 438 A1 | 2/1997 | (DE) . |
| 0 308 728 A1 | 3/1989 | (EP) . |
| 1 603 219 | 11/1981 | (GB) . |

* cited by examiner

*Primary Examiner*—Denise L. Ferensic
*Assistant Examiner*—Gregory A. Wilson
(74) *Attorney, Agent, or Firm*—Herbert L. Lerner; Laurence A. Greenber; Werner H. Stemer

(57) ABSTRACT

In a once-though steam generator having a double-flue configuration, a first gas flue is followed on the fuel-gas side, by way of a horizontal gas flue, by a second gas flue. In a once-through steam generator of this type, which is to have a particularly long lifetime even in the case of frequent start-up operations, according to the invention a number of steam generator tubes, connected in parallel for a flow medium to flow through them, are connected to one another to form an evaporator heating surface which is part of a containing wall of the first gas flue. The steam generator tubes which form the evaporator heating surface opening on an exit into an outlet header which is common to them and is disposed at a lower height in comparison with the bottom edge of the horizontal gas flue and which is followed, on the flow-medium side, by a bulkhead heating surface.

4 Claims, 2 Drawing Sheets

ONCE-THROUGH STEAM GENERATOR AND METHOD FOR STARTING UP A ONCE-THROUGH STEAM GENERATOR

CROSS-REFERENCE TO RELATED APPLICATION

This application is a continuation of copending International Application No. PCT/DE98/01055, filed Apr. 14, 1998, which designated the United States.

BACKGROUND OF THE INVENTION

Field of the Invention

The invention relates to a once-through steam generator having a first gas flue followed on the fuel-gas side, by way of a horizontal gas flue, a second gas flue. A steam generator of this type is known from Published, European Patent Application EP 0 308 728 A1.

In a once-through steam generator, the heating of a number of evaporator tubes, which together form the gas-tight containing wall of a combustion chamber, leads to complete evaporation of the flow medium in the evaporator tubes in a single pass. The flow medium, usually water, after evaporating, is supplied to superheater tubes located downstream of the evaporator tubes and is superheated there. In contrast to a natural-circulation steam generator, a once-through steam generator is not subject to any pressure limitation, so that fresh steam pressures well above the critical pressure of water ($P_{crit}$=221 bar), where there is still only a slight difference in density between a liquid-like and a steam-like medium, are possible. A high fresh steam pressure is condusive to high thermal efficiency and therefore low $CO_2$ emissions of a fossil-fired power station.

A once-through steam generator of this type can have a single-flue configuration or else a double-flue configuration.

In the case of a once-through steam generator of the single-flue configuration, the steam generator tubes are usually welded to one another in a gas-tight manner in order to form the containing wall of a single gas flue, the gas flue being disposed vertically. In this case, as a rule, the steam generator tubes forming the containing wall of the gas flue contain both evaporator tubes and superheater tubes located downstream of these on the flow-medium side. A combustion chamber with a number of burners for fossil fuel is usually provided in a lower region of space of the gas flue.

In the case of a once-through steam generator having a double-flue configuration, steam generator tubes are likewise usually welded to one another in a gas-tight manner in order to form the containing wall of a vertically disposed first gas flue. In this configuration, however, the first gas flue is followed by way of a horizontal gas flue, on the fuel-gas side, by a second vertically disposed gas flue, the containing wall of which is likewise formed by steam generator tubes and through which the fuel gas normally flows from the top downwards. A once-through steam generator having a double-flue configuration usually has a lower overall height, as compared with a once-through steam generator having a single-flue configuration, and differs from this in a number of configuration parameters.

In a once-through steam generator having the double-flue configuration, the steam generator tubes forming the containing wall of the first gas flue are normally configured as evaporator tubes, whereas steam generator tubes configured as superheater tubes are part of the containing wall of the second gas flue and/or part of a wall heating surface of the horizontal gas flue. In other words, the steam generator tubes assigned to the horizontal gas flue and those assigned to the second gas flue are usually located downstream, on the flow medium side, of the steam generator tubes assigned to the first gas flue. For this purpose, the steam generator tubes assigned to the first gas flue open on the outlet side into an outlet header which is common to them and which is followed, by way of a water/steam separating device and by way of a number of heating surfaces disposed in a horizontal gas flue, by an inlet header for the steam generator tubes assigned to the second gas flue.

In the once-through steam generator known from the Published, European Patent Application EP 0 308 728 A1, a number of steam generator tubes connected in parallel for a flow medium to flow through them are connected to one another to form an evaporator heating surface which is part of the containing wall of the first gas flue. In this case, the steam generator tubes forming the evaporator heating surface open on the outlet side into an outlet header which is common to them and which is disposed at a lower height, as compared with a bottom edge of the horizontal gas flue.

In a configuration of this type, particularly during start-up, also referred to as hot start-up, after a comparatively short shutdown time prior to the ignition of the burners, when steam generator tubes of the still hot once-through steam generator are being filled with cold feed water, considerable temperature differences may occur between the steam generator tubes assigned to the first gas flue and steam generator tubes assigned to a containing wall of the horizontal flue. Temperature differences of this kind may give rise to inadmissible thermal stresses, particularly at a connection point at which the containing wall of the first gas flue is welded to a wall of the horizontal flue. Due to thermal stresses of this kind, the lifetime of the once-through steam generator of this type is only limited because of high alternating stress, particularly in the case of frequent start-up operations. In this case, the thermal stresses occur particularly after only a short shutdown of the once-through steam generator, that is to say, for example, after a night-time shutdown, since the once-through steam generator then normally still has a temperature which is high in comparison with the temperature of the feed water.

SUMMARY OF THE INVENTION

It is accordingly an object of the invention to provide a once-through steam generator and method for starting up a once-through steam generator which overcome the above-mentioned disadvantages of the prior art devices and methods of this general type, which is of double-flue construction and which has a particularly long lifetime, even in the case of frequent start-up operations.

With the foregoing and other objects in view there is provided, in accordance with the invention, a once-through steam generator, including:

- a first gas flue having a containing wall, a combustion chamber, and a plurality of steam generator tubes connected in parallel for conducting a flow medium and each having an outlet side, the plurality of steam generator tubes connected to one another forming a gas-tight evaporator heating surface and forming part of the containing wall;
- a horizontal gas flue disposed downstream of the first gas flue and having a bottom edge;
- a second gas flue following the first gas flue on a fuel-gas side by way of the horizontal gas flue;
- an outlet header, the plurality of steam generator tubes forming the gas-tight evaporator heating surface opening on the outlet side into the outlet header, the outlet header being common to the plurality of steam generator tubes and disposed at a lower height in comparison with the bottom edge of the horizontal gas flue;

a bulkhead heating surface directly following the outlet header on a flow-medium side, the bulkhead heating surface disposed in a region of space within the first gas flue above the combustion chamber; and a water/steam separating device following the bulkhead heating surface on the flow-medium side.

As regards the once-through steam generator of the above-mentioned type, the object is achieved, according to the invention, in that the outlet header is followed directly, on the flow-medium side, by the bulkhead heating surface. The bulkhead heating surface is disposed in a region of space within the first gas flue above the combustion chamber and the bulkhead heating surface being followed, on the flow-medium side, by the water/steam separating device.

The bulkhead heating surface is to be understood, in this case, as a number of steam generator tubes connected in parallel for the flow medium to flow through them and opening into the common inlet header and the common outlet header. The steam generator tubes being located closely next to one another in one plane and thus forming a number of plate-like heating surfaces that are suspended within the gas flue.

The invention proceeds, in this case, from the consideration that, for a particularly long lifetime of the once-through steam generator, even in the case of frequent start-up operations, the thermal stresses between the containing wall of the first gas flue and the walls of the horizontal gas flue should be kept particularly low. For this purpose, the temperature differences between the steam generator tubes filled with cold feed water immediately prior to the ignition of the burners and assigned to the first gas flue and the walls of the horizontal gas flue, which are still comparatively hot in the event of a hot start-up, should be kept particularly low.

For this purpose, the outlet header of the steam generator tubes assigned to the first gas flue is disposed at a height dimensioned in such a way as to avoid direct contact of the steam generator tubes filled with cold feed water prior to the start-up with the walls of the horizontal gas flue which are still hot in the event of a hot start-up. On the other hand, so that the steam generator tubes assigned to the horizontal gas flue are cooled particularly effectively as early as during the start-up, the heating surfaces provided for steam generation are given particularly large dimensions. For this purpose, the steam generator tubes forming the evaporator heating surface are followed by the bulkhead heating surface as an additional heating surface provided for steam generation.

In this case, the bulkhead heating surface is disposed in a region of space within the first gas flue above the combustion chamber provided in the first gas flue. The bulkhead heating surface is therefore disposed in a region of space particularly highly heated, even during the start-up of the once-through steam generator, and contributes to a particularly great extent to steam generation. Thus, even when the once-through steam generator is being started up, a large steam quantity is generated which contributes to particularly effective cooling of the steam generator tubes which follow the steam generator tubes provided as evaporator tubes and which are configured as superheater tubes.

For particularly low thermal stresses between the wall heating surfaces of the first gas flue and the wall heating surfaces of the horizontal gas flue, an approximately horizontal separating line between the steam generator tubes filled with water during the start-up and the steam generator tubes filled with steam during the start-up is advantageously provided in a region of space above the burners disposed in the first gas flue and below the bottom edge of the horizontal gas flue. This separating line may be configured in such a way that the thermal stresses occurring at this point are kept particularly low. This reliably prevents heating surfaces, cooled to a sharply differing extent during start-up, from meeting in the transitional region from the first gas flue to the horizontal gas flue.

For this purpose, the bulkhead heating surface is followed, on the flow-medium side, by a water/steam separating device which, during operation, uncouples the evaporator tubes, through which evaporating flow medium flows, from the superheater tubes, through which evaporated flow medium flows.

In a further advantageous refinement, a steam-side outlet of the water/steam separating device is connected to an inlet header for a number of further steam generator tubes provided as the superheater tubes. These steam generator tubes form the upper part of the containing wall of the first gas flue, and the inlet header being disposed at a lower height in comparison with the bottom edge of the horizontal gas flue.

As regards the method for starting up such a once-through steam generator of the double-flue configuration, the object is achieved, in that the flow-medium throughput of the steam generator tubes forming the evaporator heating surface is temporarily reduced after the ejection of water from the tubes has commenced.

In particular, when the once-through steam generator is being started up, part of the non-evaporated flow medium or water contained in the evaporator tubes is replaced by steam. This operation takes place during the start-up and leads to a briefly increased flow-medium throughput at the outlet of the evaporator tubes, also referred to as water ejection. The ejected water normally has to be discharged from the once-through steam generator and therefore gives rise to a heat loss from the once-through steam generator.

In a particularly advantageous method for starting up the once-through steam generator, therefore, the water ejection should be kept particularly low. This can be achieved, for the once-through steam generator illustrated above, in that, prior to the ignition of the burners, the steam generator tubes assigned to the containing wall of the first gas flue are first filled with non-evaporated flow medium up to a level of the outlet header located downstream of the tubes. In this case, excess non-evaporated flow medium or water, bypassing the bulkhead heating surface, can be conducted directly to the water/steam separating device via a bypass valve. When the burners are ignited, an initial mass flow of flow medium or feed water is first supplied to the steam generator tubes configured as evaporator tubes. The flow medium partially evaporates in the steam generator tubes opening into the outlet header, the non-evaporated flow medium passing into the bulkhead heating surface located downstream of the outlet header. Since the bulkhead heating surface is likewise configured as an evaporator heating surface and can therefore be fed with non-evaporated flow medium, the non-evaporated flow medium which has arrived there can be further evaporated there without harmful effects. In this case, sufficient cooling of all the steam generator tubes is reliably ensured, the mass flow of feed water being initially reduced temporarily after the commencement of the ejection of water, in order to achieve particularly low water ejection.

Advantageously, after the flow-medium throughput through the steam generator tubes forming the evaporator heating surface has been reduced, the throughput is set in proportion to the firing heat capacity of the once-through steam generator.

The advantages achieved by the invention are, in particular, that, due to the outlet header of the evaporator heating surface, the outlet header being disposed at a height between the burners assigned to the first gas flue and the bottom edge of the horizontal gas flue, an approximately horizontal separating line is produced between the steam generator tubes filled with water during the start-up and the steam generator tubes filled with steam, in a region of space which is particularly advantageous for preventing thermal stresses. In this case, the occurrence of thermal stresses in the transitional region from the first gas flue to the horizontal gas flue is reliably avoided, so that the once-through steam generator has a particularly long lifetime, even in the case of frequent start-up operations. Moreover, the bulkhead heating surface ensures that, during start-up, a sufficiently large evaporator heating surface is available for generating a particularly high steam mass flow and thus ensuring reliable cooling of all the steam generator tubes.

Furthermore, the bulkhead heating surface also provides an intermediate store for non-evaporated flow medium which is ejected from the evaporator heating surface during the start-up. The non-evaporated flow medium which is passed into the bulkhead heating surface evaporates there, so the water quantity resulting from water ejection and to be discharged from the once-through steam generator during start-up is particularly small.

Other features which are considered as characteristic for the invention are set forth in the appended claims.

Although the invention is illustrated and described herein as embodied in a once-through steam generator and method for starting up a once-through steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
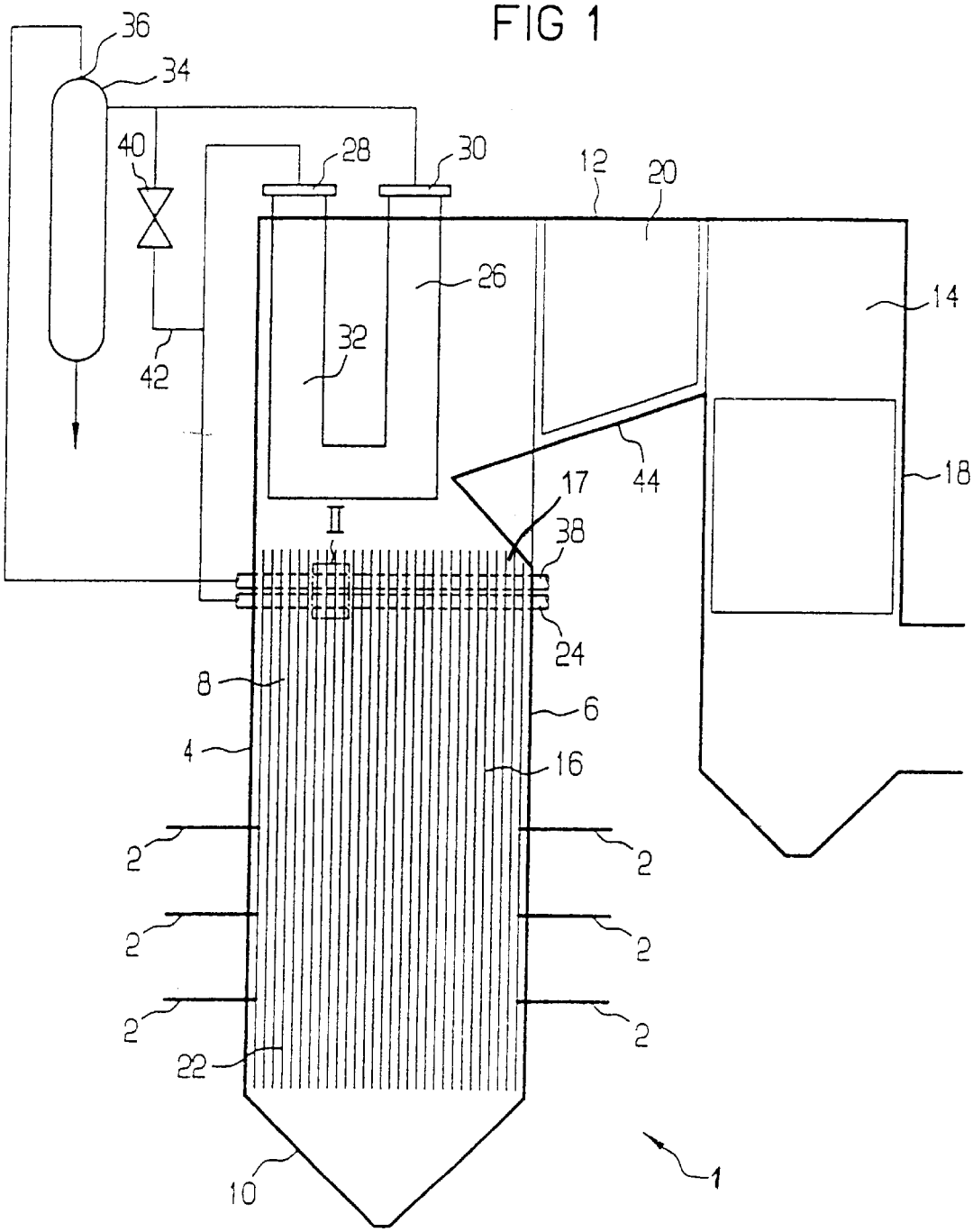
FIG. 1 is a diagrammatic illustration of a once-through steam generator having a double-flue configuration.

In all the figures of the drawing, sub-features and integral parts that correspond to one another bear the same reference symbol in each case. Referring now to the figures of the drawing in detail and first, particularly, to FIG. 1 thereof, there is shown a once-through steam generator 1 containing a number of burners 2 for a fossil fuel, which are illustrated diagrammatically in FIG. 1 by their main axes. The burners 2 are disposed in a combustion chamber 4 which is formed by a lower part of a containing wall 6 of a vertically disposed first gas flue 8. The containing wall 6 merges, at a lower end of the first gas flue 8 formed by it, into a funnel-shaped bottom 10.

The once-through steam generator 1 according to FIG. 1 has a double-flue configuration. For this purpose, the first gas flue 8 for fuel gas occurring as a result of the combustion of the fossil fuel is followed by way of a horizontal gas flue 12 by a second gas flue 14. In this case, the second gas flue 14 is likewise disposed vertically.

The containing wall 6 of the first gas flue 8 is composed of steam generator tubes 16, 17 which are connected, for example welded, to one another in a gas-tight manner on their longitudinal sides. A containing wall 18 of the second gas flue 14 is likewise composed, in a similar manner, of steam generator tubes, not illustrated in any more detail, which are connected to one another in a gas-tight manner on their longitudinal sides. The horizontal gas flue 12, in turn, contains a number of steam generator tubes, not illustrated in any more detail, which are combined to form heating surfaces 20 disposed in its likewise gas-tight containing wall. As illustrated in FIG. 1, the steam generator tubes 16, 17 forming the containing wall 6 of the first gas flue 8 are disposed vertically. Alternatively, however, the steam generator tubes 16, 17 may also be disposed so as to ascend obliquely around the first gas flue 8 in the manner of a helical winding.

The steam generator tubes 16 forming the containing wall 6 of the first gas flue 8 in the lower region of space are configured as evaporator tubes and are combined to form a number of evaporator heating surfaces 22, each of which is part of the containing wall 6 of the first gas flue 8. The steam generator tubes 16 of each of the evaporator heating surfaces 22 are connected in parallel for water to flow through them as a flow medium and are connected at their inlet ends to a non-illustrated common inlet header and at their outlet ends to a common outlet header 24.

The outlet header 24 is followed, on the flow-medium side, by a bulkhead heating surface 26. In this case, the bulkhead heating surface 26 consists of a number of steam generator tubes, not illustrated in any more detail, which are connected in parallel for the flow medium to flow through them and which are connected on the inlet side to a common inlet header 28 and on the outlet side to a common outlet header 30. The steam generator tubes forming the bulkhead heating surface 26 are disposed lying closely next to one another in one plane and form a number of plate-like heating surfaces which are suspended within the first gas flue 8 or the horizontal gas flue 12.

The bulkhead heating surface 26 is followed, on the flow-medium side, by a water/steam separating device 34, a steam-side outlet 36 of which is connected to an inlet header 38 for a number of further steam generator tubes 17 which are merely indicated in FIG. 1 for the sake of greater clarity. The further steam generator tubes 17 are configured as superheater tubes and are combined to form a number of superheater heating surfaces, not illustrated in any more detail, which form the containing wall 6 of the first gas flue 8 in the upper region of space 32. Moreover, a bypass conduit 42 capable of being shut off by a bypass valve 40 is inserted, bypassing the bulkhead heating surface 26, into the flow path between the outlet header 24 and the water/steam separating device 34.

Figure 2:
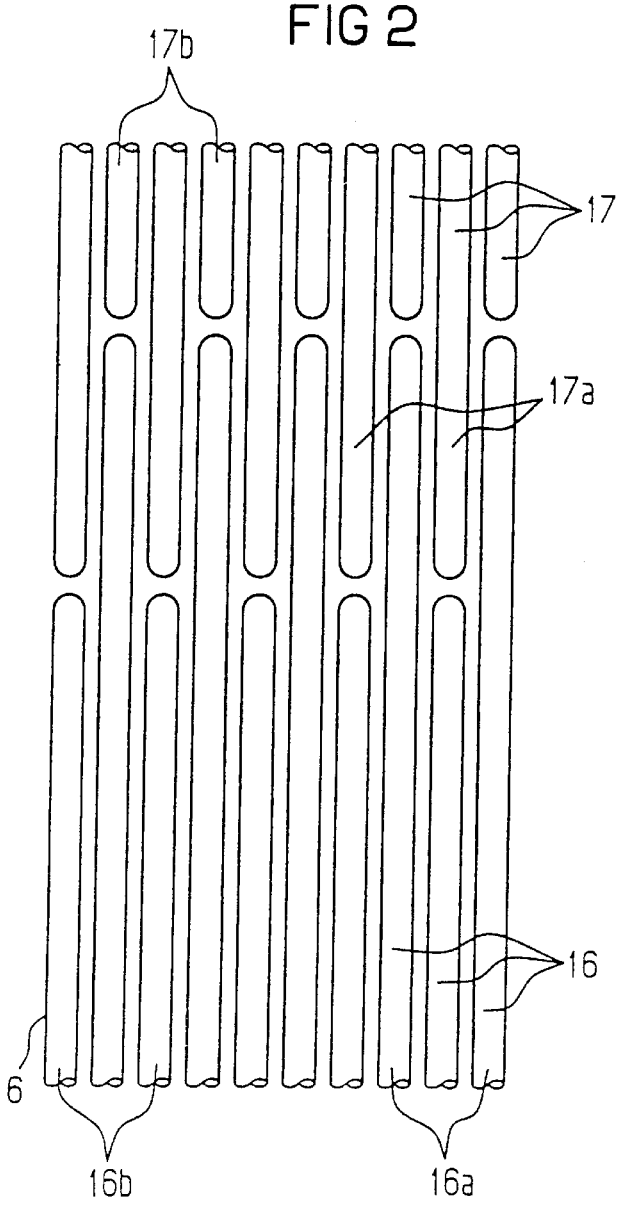
FIG. 2 is a fragmented, enlarged front-elevational view of a detail of a containing wall of the once-through steam generator according to FIG. 1.

As illustrated in FIG. 2, the steam generator tubes 16, 17 are mounted in the containing wall 6 of the first gas flue 8 in an interlocked configuration in a region level with the outlet header 24 and the inlet header 38. For this purpose, the steam generator tubes 16 forming the containing wall 6 of the first gas flue 8 in the lower region of space are combined into two groups of steam generator tubes **16*a* and 16*b*, the steam generator tubes 16*a* assigned to the first group having a greater length than the steam generator tubes 16*b* assigned to the second group. In a similar way, the steam generator tubes 17 forming the containing wall 6 of the first gas flue 8 in the upper region of space are combined into two groups of steam generator tubes 17***a* and 17*b*, the steam generator tubes 17*a* assigned to the first group having a greater length than the steam generator tubes 17*b* assigned to the second group.

Figure 3:
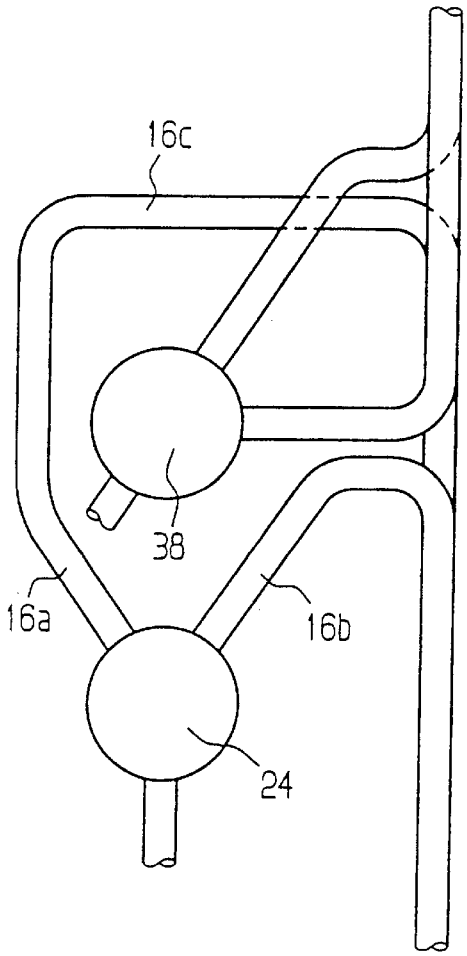
FIG. 3 is a fragmentary, side-elevational view of an inlet header and an outlet header of the once-through steam generator according to FIG. 1.

In this case, each of the comparatively shorter steam generator tubes 17*b* is disposed above a comparatively longer steam generator tube 16*a* in each case, each of the comparatively longer steam generator tubes 17*a* being disposed above a comparatively shorter steam generator tube 16*b* in each case. As illustrated in FIG. 3, both the comparatively shorter steam generator tubes 16*b* and the comparatively longer steam generator tubes 16*a* open into the outlet header 24, a tubular supply piece 16*c* being provided in each case for the comparatively longer steam generator tubes 16*a*. Both the comparatively shorter steam generator tubes 17*a* and the comparatively longer steam generator tubes 17*b* are connected to the inlet header 38 in a similar way.

Due to the interlocked configuration of the steam generator tubes 16, 17 in the region of the outlet header 24 and of the inlet header 38, temperature equalization is ensured even if there is different heating and/or different cooling of the steam generator tubes 16, as compared with the further steam generator tubes 17. The thermal stresses that occur are thus kept particularly low.

As is evident from FIG. 1, the further steam generator tubes 17 are followed on the flow-medium side, by way of the heating surfaces 20 disposed in the horizontal gas flue 12, by the steam generator tubes forming the containing wall 18 of the second gas flue 14. Both the steam generator tubes forming the heating surfaces 20 of the horizontal gas flue 12 and the steam generator tubes forming the containing wall 18 of the second gas flue 14 are provided as superheater tubes and are adapted, in terms of their configuration, to the fuel-gas and flow-medium parameters which depend on the place where they are disposed.

The outlet header 24, into which the steam generator tubes 16 forming the evaporator heating surface 22 open, is disposed at a lower height in comparison with a bottom edge 44 of the horizontal gas flue 12. By contrast, the inlet header 38, located jointly upstream of the further steam generator tubes 17 configured as the superheater tubes, is disposed at a height between the outlet header 24 and the bottom edge 44 of the horizontal gas flue. That is to say at a greater height in comparison with the outlet header 24 and at a lower height in comparison with the bottom edge 44 of the horizontal gas flue 12. Alternatively, however, the inlet header 38 may also be disposed at a lower height in comparison with the outlet header 24.

For starting up the once-through steam generator 1, prior to the ignition of the burners 2 the steam generator tubes 16 assigned to the first gas flue 8 and forming the containing wall 6 in the lower region of space are first filled with a non-evaporated flow medium, that is to say with water, up to the level of the outlet header 24 located downstream of the tubes. In this operating state, the bypass valve 40 is opened. When the burners 2 are ignited, an initial mass flow of feed water is first supplied to the steam generator tubes 16 configured as evaporator tubes. The feed water supply evaporates partially in the steam generator tubes 16 opening into the outlet header 24, the non-evaporated residue of feed water passing into the bulkhead heating surface 26 located downstream of the outlet header 24. The bulkhead heating surface 26 is likewise configured as an evaporator heating surface and can therefore be fed with non-evaporated feed water without harmful effects. The non-evaporated residue of feed water is thus largely evaporated in the bulkhead heating surface 26. In this case, if required, part of the mass flow emerging from the outlet header 24 may be supplied directly to the water/steam separating device 34 by way of the bypass conduit 42.

On account of the bulkhead heating surface 26 provided by the steam generator tubes in addition to the steam generator tubes 16 configured as evaporator tubes, the heating surface altogether available for steam generation is therefore particularly large. Sufficient steam production for the reliable cooling of all the steam generator tubes located downstream of the water/steam separating device 34 and configured as the superheater tubes is thus ensured, even when only a small mass flow of feed water is supplied.

So that the residue of non-evaporated feed water emerging from the bulkhead heating surface 26 during the start-up and referred to as water ejection is kept particularly low, in this case the mass flow of feed water supplied to the steam generator tubes 16 is first reduced temporarily, proceeding from an initial value, in an initial phase of the start-up process.

After being reduced, the mass flow of feed water supplied to the steam generator tubes 16 is set in proportion to the firing heat capacity of the once-through steam generator 1.

Since the outlet header 24 of the evaporator heating surface 22 is disposed, in terms of height, between the burners 2 assigned to the first gas flue 8 and the bottom edge 44 of the horizontal gas flue 12, an approximately horizontal separating line is produced between the steam generator tubes 16 filled with water during the start-up and the steam generator tubes 17 filled with steam. Thermal stresses between adjacent wall parts of the gas flues 8, 12, 14 can therefore occur mainly in the vicinity of the horizontal separating line which is defined by the outlet header 24 and by the inlet header 38. The occurrence of thermal stresses in a transitional region from the first gas flue 8 to the horizontal gas flue 12 is reliably avoided in this case, so that the once-through steam generator 1 has a particularly long lifetime, even in the case of frequent start-up operations. Moreover, due to the interlocked configuration of the steam generator tubes 16, 17 in the region of the outlet header 24 and of the inlet header 38, temperature equalization is ensured, even when there is different heating and/or different cooling of the steam generator tubes 16, as compared with the further steam generator tubes 17. Thermal stresses that occur are thus kept particularly low.

Moreover, the bulkhead heating surface 26 ensures that, during start-up, a sufficiently large evaporator heating surface is available for ensuring that even the further steam generator tubes 17 located downstream of the steam generator tubes 16 on the flow-medium side and configured as superheater tubes are cooled reliably. Furthermore, the bulkhead heating surface 26 also provides an intermediate store for non-evaporated flow medium that has been ejected from the evaporator heating surface 22 during the start-up. The non-evaporated flow-medium which has passed into the bulkhead heating surface 26 evaporates there, so that the water ejection of the once-through steam generator 1 during start-up and the associated heat loss are particularly low.

I claim:

1. A once-through steam generator, comprising:

a first gas flue having a containing wall, a combustion chamber, and a plurality of steam generator tubes connected in parallel for conducting a flow medium and each having an outlet side, said plurality of steam generator tubes connected to one another forming a gas-tight evaporator heating surface and forming part of said containing wall;

a horizontal gas flue disposed downstream of said first gas flue and having a bottom edge;

a second gas flue following said first gas flue on a fuel-gas side by way of said horizontal gas flue;

an outlet header, said plurality of steam generator tubes forming said gas-tight evaporator heating surface opening on said outlet side into said outlet header, said outlet header being common to said plurality of steam generator tubes and disposed at a lower height in comparison with said bottom edge of said horizontal gas flue;

a bulkhead heating surface directly following said outlet header on a flow-medium side, said bulkhead heating surface disposed in a region of space within said first gas flue above said combustion chamber; and a water/steam separating device following said bulkhead heating surface on the flow-medium side.

2. The once-through steam generator according to claim 1, wherein said water/steam separating device has a steam-side outlet;

including a plurality of further steam generator tubes guided in said containing wall of said first gas flue; and including an inlet header for said plurality of further steam generator tubes and connected to said steam outlet side, said inlet header disposed at a lower height in comparison with said bottom edge of said horizontal gas flue.

3. A method for starting up a once-through steam generator containing a first gas flue having a containing wall, a combustion chamber, and a plurality of steam generator tubes connected in parallel for conducting a flow medium and each having an outlet side, the plurality of steam generator tubes connected to one another forming a gas-tight evaporator heating surface and forming part of the containing wall of the first gas flue; a horizontal gas flue disposed downstream of the first gas flue and having a bottom edge; a second gas flue following the first gas flue on a fuel-gas side by way of the horizontal gas flue; an outlet header, the plurality of steam generator tubes forming the gas-tight evaporator heating surface opening on the outlet side into the outlet header, the outlet header being common to the plurality of steam generator tubes and disposed at a lower height in comparison with the bottom edge of the horizontal gas flue; a bulkhead heating surface directly following the outlet header on a flow-medium side, the bulkhead heating surface disposed in a region of space within the first gas flue above the combustion chamber; and a water/steam separating device following the bulkhead heating surface on the flow-medium side, the method which comprises:

reducing a flow-medium throughput of the plurality of steam generator tubes forming the gas-tight evaporator heating surface after a commencement of an ejection of water from the plurality of steam generator tubes.

4. The method according to claim 3, which comprises setting the flow-medium throughput through The plurality of steam generator tubes forming the gas-tight evaporator heating surface in proportion to a firing heat capacity of the first gas flue after the reducing step.

* * * * *